United States Patent [19]

Bui Hai

[11] 4,249,183

[45] Feb. 3, 1981

[54] PERISCOPE ARRANGEMENT WITH PROTECTION AGAINST PARASITIC RADIATION

[75] Inventor: Nhu Bui Hai, Paris, France

[73] Assignee: Thomson-CSF, Paris, France

[21] Appl. No.: 786,627

[22] Filed: Apr. 11, 1977

[30] Foreign Application Priority Data

Apr. 16, 1976 [FR] France ..... 76 11443

[51] Int. Cl.[3] ..... H01Q 15/16

[52] U.S. Cl. ..... 343/781 R; 343/786; 343/840

[58] Field of Search ..... 343/781 P, 781 R, 840, 343/786, 837, 755

[56] References Cited

U.S. PATENT DOCUMENTS

| | | | |
|---|---|---|---|
| 2,665,383 | 1/1954 | Marie | 343/755 |
| 3,689,923 | 9/1972 | Tocquec | 343/781 P |
| 3,936,837 | 2/1976 | Coleman et al. | 343/786 |

FOREIGN PATENT DOCUMENTS

| | | | |
|---|---|---|---|
| 726058 | 3/1955 | United Kingdom | 343/786 |

OTHER PUBLICATIONS

Curtis Siller, Jr. and Paul Butzien "A Radio Antenna for Application at 18 GHz", 1974 International IEEE AP-S Symposium p. 254.

Graeme James and Vassilios Kerdemelidis "Null Shaping in Radiation Patterns by Shaping Antenna Edges" Electronics Letters 8/28/72, vol. 8 #17.

*Primary Examiner*—David K. Moore

*Attorney, Agent, or Firm*—Cushman, Darby & Cushman

[57] ABSTRACT

A cylindrical metal sheath surrounds the beam rays between the antenna and the passive reflector of a periscope arrangement; this sheath forms the support of the periscope arrangement as well as a screen against parasitic radiation.

1 Claim, 7 Drawing Figures

PERISCOPE ARRANGEMENT WITH PROTECTION AGAINST PARASITIC RADIATION

The present invention relates to a periscope arrangement comprising an antenna and a passive reflector located for receiving plane waves from said antenna. Arrangements of this kind are currently used in radio-relay links.

In such arrangements the antenna is near the ground and the passive reflector located at a height which may reach between 100 and 200 meters.

The known periscope arrangements have various drawbacks.

The mounting for the passive reflector, more often than not is constituted by a concrete pylon or a metal mast that is expensive. However, if the different operating frequency bands of the arrangements of one and the same array are not sufficiently spaced from one another, the scattering and back lobes of these arrangements inhibit the attachment of more than a restricted number of passive reflectors to one and the same mounting. The result is that the cost of the mounting in a periscope arrangement remains high even if we regard it as the cost of the pylon divided by the number of passive reflectors attached to the latter.

It is known to considerably reduce these drawbacks either by the use of collars or sleeves arranged in the neighbourhood of the passive reflector and designed to intercept parasitic radiation, or by the use of iris arrangements arranged between the antenna and its passive reflector. Such arrangements are, for example, described in U.S. Pat. No. 2,717,312.

However, these known solutions are inadequate in the case of very high-capacity radio-relay beams (1800 channels and more per link) because decoupling factors of between 65 to 70 dB are often necessary in directions which may only be 40° away from the propagation direction in question.

The object of the present invention is to reduce these drawbacks well beyond the limits achieved using the known solutions and accordingly to make it possible to form arrays of several periscope arrangements for very high-capacity radio relay links. The invention makes it possible to operate in directions which are separated from one another by only around 40°.

According to the invention, there is provided a periscope arrangement with protection against parasitic radiations comprising: a directive antenna having its maximal gain in a first direction; a passive reflector associated with said antenna for receiving therefrom in the first direction plane waves and reflecting in a second direction the beam rays received from said antenna in said first direction; and a metal sheath surrounding the beam path between said antenna and said passive reflector, said sheath including a hollow cylindrical tube and acting both as a support for said periscope arrangement and as a protection against parasitic radiation.

It should be noted that in U.S. Pat. No. 2,665,383 there is shown a periscope arrangement comprising an antenna associated with a passive reflector, the beam path between the antenna and the reflector passing inside a tower surrounding the reflector. However the tower is only part of a building wherein the periscope arrangement is accommodated and nothing suggests the use of a metal tower as a screen against parasitic radiations.

The invention will be better understood and other of its features rendered apparent from a consideration of the ensuing description and the related drawings in which.

Figure 1:
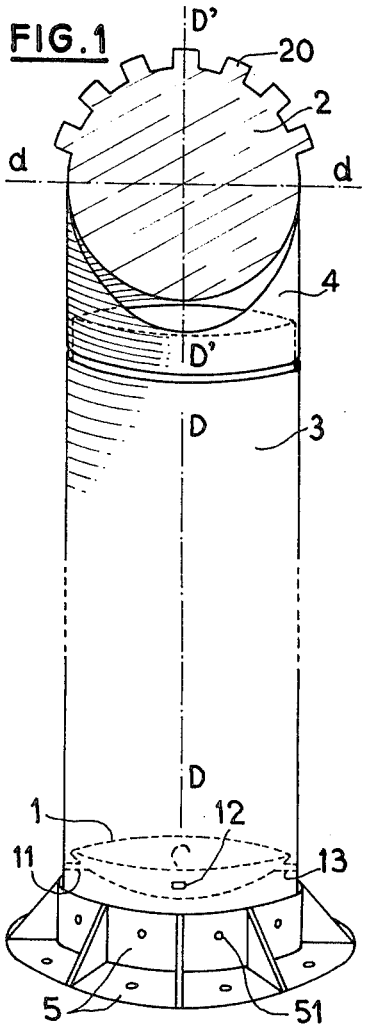
FIGS. 1 and 2 are two views of a periscope arrangement in accordance with the invention.
Figure 2:
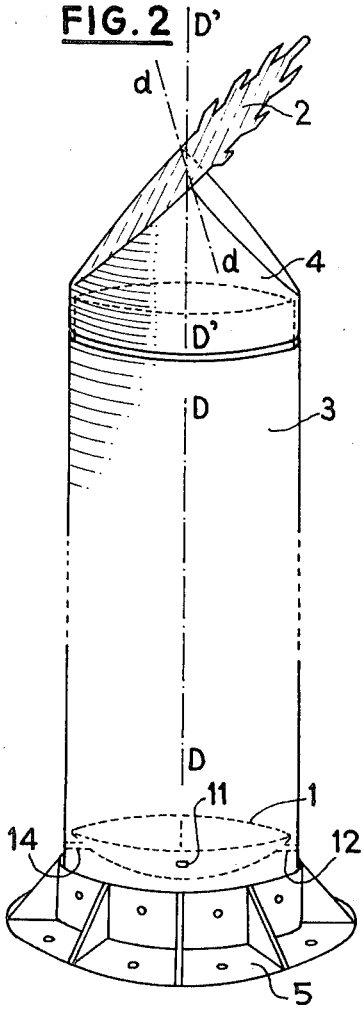
Figure 7:
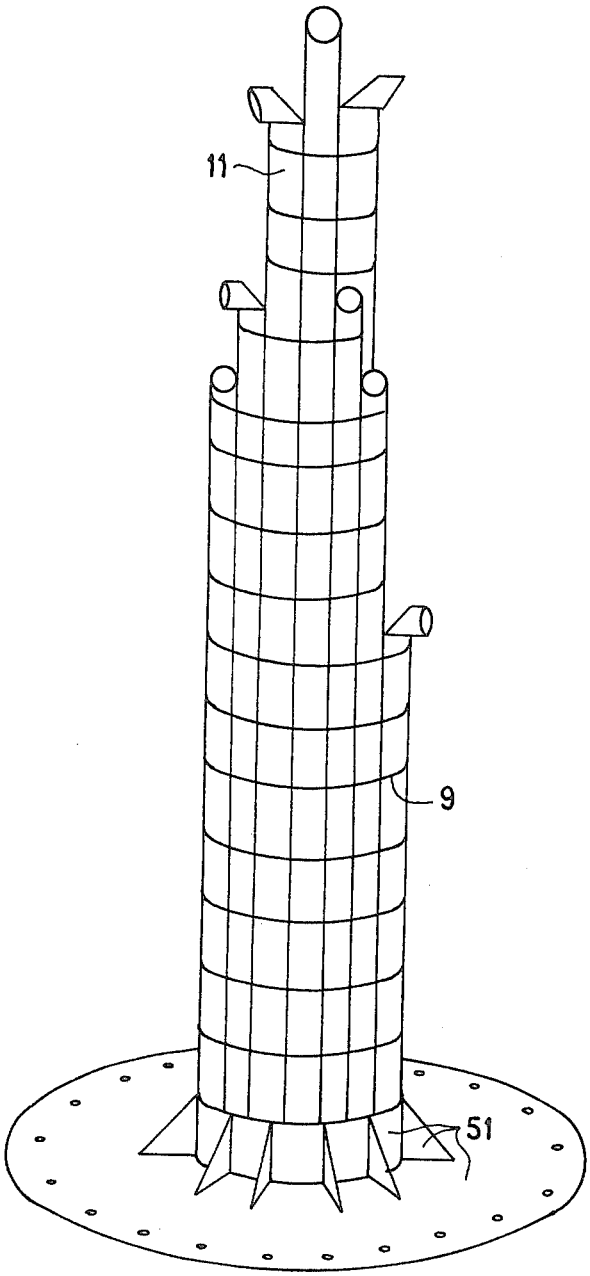

FIG. 7 illustrates an array of periscope arrangements in accordance with the invention. FIGS. 1 and 2 are two views of the same periscope arrangement whose radiating section is made up of a directive antenna 1, located near the ground, and of a passive reflector 2 located vertically above the antenna 1. The antenna 1 is assembled in such a way as to radiate in the vertical direction, more precisely the antenna has its maximal gain in the vertical direction and radiates a narrow lobe centred in that direction. The passive reflector received plane waves from the antenna and is assembled in order that the periscope arrangement radiates in a horizontal direction. The periscope arrangement is inherently stable and for that purpose comprises:

a base component 5 of ring shape, designed for attachment to the ground;

a hollow, vertical metal tube 3, of longitudinal axis D, having a height of 45 meters, a diameter of 2.50 meters and a mean thickness of 10 mm; the tube 3 is inserted into the base component 5 and is attached there by bolts such as that 51 whose head can be seen in FIG. 1; the external diameter of the tube 3 remains constant over its full length except at the top end where it is smaller in order to enable it to be inserted into a location, insertion taking place over a length equal to the length of the smaller diameter section;

tie members 11, 12, 13, 14 which enable the antenna 1 to be fixed inside the tube 3 in the neighbourhood of the bottom end thereof;

a terminal section 4, to which the passive reflector is welded; this terminal section is attached to a top end of the tube 3, by sliding it over same; the terminal section is a hollow component formed from a section of tube having the same cross-section as the largest of the sections of the tube 3; this tube section is cut, at its bottom end, in a plane perpendicular to its own longitudinal axis D' and, at its top end, in two planes intersecting each other along a straight line d perpendicular to the axis D' and each making an angle of 45° with the latter axis; when the tube 3 and the terminal section 4 are assembled together, their longitudinal axes d and D' coincide.

The direction of maximum radiation is adjustable in the horizontal plane by rotation, about the longitudinal axis D of the tube 3 of the assembly formed by the passive reflector 2 and the terminal section 4. When the passive reflector is properly aligned, the terminal section 4 is secured to the tube 3 either by welding or by a clamping collar, or by the use of rivets.

The tube 3, in addition to supporting the periscope arrangement, reduces parasitic radiation effects since, together with the terminal section 4 and the passive reflector 2, it surrounds the major part of the beam path between the antenna 1 and the passive reflector 2.

In order to reduce the parasitic radiation and more specifically the level of the back radiation from the periscope arrangement, the passive reflector 2, at its top part, has a periphery which is castellated in the form of a succession of non-contiguous rectangles such as that 20 shown in FIG. 1.

Figure 3:
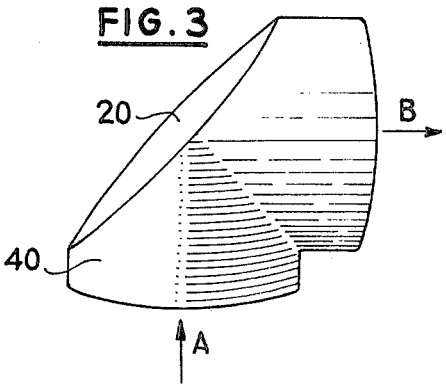
FIGS. 3 and 4 illustrate elements of periscope arrangements in accordance with the invention.
Figure 4:
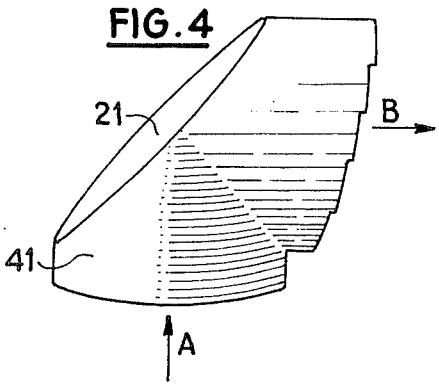

FIGS. 3 and 4 are improved variant embodiments of the terminal section 4 shown in FIGS. 1 and 2, the improvement concerning the protection against parasitic radiation.

In the case shown in FIG. 3, a terminal section 40, in association with a passive reflector 20, forms a kind of cranked metal sleeve or metal tube. In the periscope arrangement for which this sleeve is intended, the openings in the sleeve are in the one case perpendicular to the radiation direction of the antenna as indicated by an arrow A, and in the other vertical and perpendicular to the radiation direction of the periscope arrangement as indicated by an arrow B.

In the case shown in FIG. 4, a passive reflector and a terminal section form a sleeve similar to that shown in FIG. 3, with the sole distinction that the vertical opening is here replaced by an opening inclined by around 10° in relation to the vertical, its edges being castellated step fashion.

Figure 5:
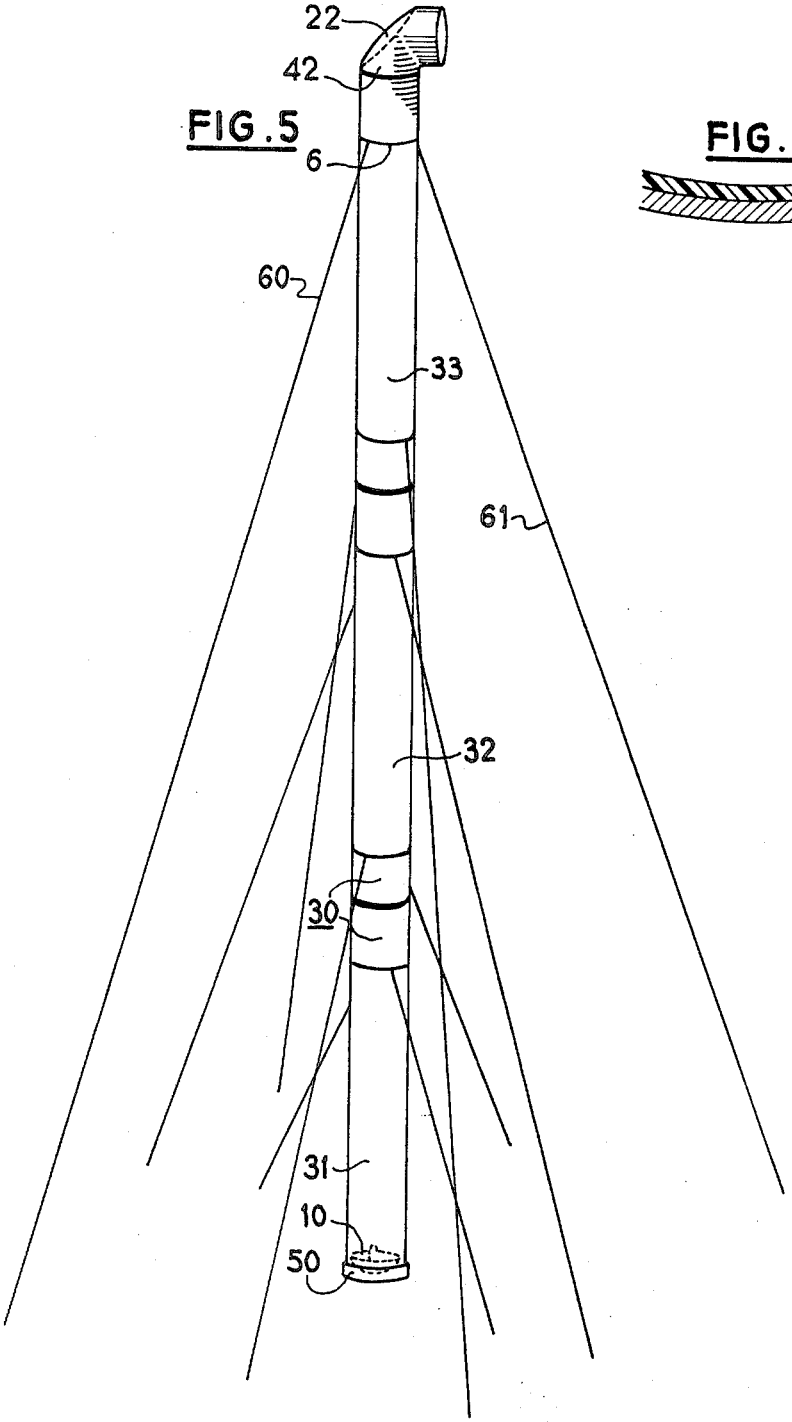
FIG. 5 illustrates a further periscope arrangement in accordance with the invention.

FIG. 5 is a general view of a guyed periscope arrangement comprising:

a directive antenna 10 located near the ground;

a passive reflector 22 located at a height of about 80 meters;

a vertical tube made up of three sections 31, 32, 33 which fit one into the other;

a base component 50 to which the bottom end of the tube 30 is attached;

a terminal section 42 of the same type as that 40 shown in FIG. 3;

five pairs of guys such as the pair 60, 61, which, in association with rings embracing the tube 30, such as the ring 6, give stability to the periscope arrangement.

Figure 6:
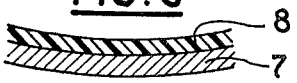
FIG. 6 illustrates a sectional view of the periscope arrangement shown in FIG. 5.

In partial cross-section FIG. 6 illustrates how the walls of the tubes 31 to 33 and of the terminal section 42 are designed, namely:

An external metal envelope 7 internally lined with a microwave absorbing layer 8; the microwave-absorbing layer 8 is here formed by a graphite-loaded polyurethane foam.

FIG. 7 is a view of an inherently stable group of periscope arrangements such as the arrangement 11; the heights of the periscope arrangements in this group or in other words array, range between 50 and 100 meters and the diameters of the tubes in the systems range between around 2 and 3 meters. The tubes in these periscope arrangements are clamped together by metal rings such as that 9, which surround them at various heights and the assembly thus formed is fitted into a common base section 51.

Of course, the invention is not limited to the embodiments described and shown which were given solely by way of example.

I claim:

1. A periscope arrangement with protection against parasitic radiations comprising:

a directive antenna having its maximal gain in a first direction;

a passive plane reflector associated with said antenna for receiving therefrom in the first direction plane waves and reflecting in a second direction the beam rays received from said antenna in said first direction; and a metal sheath surrounding the beam path between said antenna and said passive reflector, said sheath including a hollow cylindrical tube and acting both as a support for said periscope arrangement and as a protection against parasitic radiation, a base section fixed to one of the ends of said tube for attaching said periscope arrangement to the ground, and a terminal section forming a mechanical link between said tube and said passive reflector, and in the neighborhood of said passive reflector, surrounding both the beam reflected by the passive reflector when it is illuminated in said first direction, and the beam reflected by said passive reflector when it is illuminated in said second direction;

said passive reflector and said terminal section forming a hollow component with two apertures the first of which is disposed towards said antenna and the second of which forms, for said periscope arrangement, a radiating aperture whose periphery, over at least part of its length, has a castellated profile.

* * * * *